United States Patent [19]

Crook et al.

[11] Patent Number: 4,643,767

[45] Date of Patent: Feb. 17, 1987

[54] NUCLEAR GRADE STEELS

[75] Inventors: Paul Crook, Kokomo, Ind.; Richard D. Zordan, Raleigh, N.C.

[73] Assignee: Cabot Corporation, Boston, Mass.

[21] Appl. No.: 672,963

[22] Filed: Nov. 19, 1984

[51] Int. Cl.[4] ..... C22C 38/46; C22C 38/48

[52] U.S. Cl. ..... 420/12; 420/36; 420/584; 420/585; 376/900

[58] Field of Search ..... 75/128 C, 128 D, 128 G, 75/128 V; 148/37, 38; 376/900; 420/584, 585

[56] References Cited

U.S. PATENT DOCUMENTS

| | | | |
|---|---|---|---|
| 3,086,858 | 4/1963 | Edminster et al. | 75/128 V |
| 4,183,774 | 1/1980 | Balleret | 75/128 G |
| 4,236,920 | 12/1980 | Lampe et al. | 75/128 C |
| 4,487,630 | 12/1984 | Crook et al. | 148/38 |

FOREIGN PATENT DOCUMENTS

| | | | |
|---|---|---|---|
| 1086991 | 10/1980 | Canada | 148/37 |
| 52-32814 | 3/1977 | Japan | 148/38 |

*Primary Examiner*—L. Dewayne Rutledge
*Assistant Examiner*—Deborah Yee
*Attorney, Agent, or Firm*—Joseph J. Phillips; Jack Schuman

[57] ABSTRACT

Disclosed is an iron-base alloy eminently suited for use as components in nuclear energy installations. The alloy normally contains, in percent by weight, about 20% chromium, about 10% nickel, about 5.5% silicon, about 1.5% carbon, about 8% niobium plus vanadium, about 0.05% nitrogen, less than 1% cobalt as an impurity and the balance iron plus normal impurities found in alloys of this class.

7 Claims, No Drawings

NUCLEAR GRADE STEELS

FIELD OF THE INVENTION

This invention relates to chromium-nickel-silicon steels that are especially suited for use as components in nuclear operations. More specifically, it relates to steels alloyed in a manner to obtain an optimum combination of wear and engineering properties.

BACKGROUND AND PRIOR ART

The design and construction of nuclear installations require a combination of certain highly specialized engineering properties in critical metal components. The alloys must have a high degree of mechanical, chemical and physical properties, including favorable nuclear characteristics, such as a short half life, resistance to radiation damage and the like.

Many alloys are available in the art that provide a number of these properties and characteristics. However, none is known to provide an optimum combination for use as a nuclear grade steel. U.S. Pat. No. 1,790,177, for example, discloses certain steel alloys suggested for a large variety of uses. These iron-base alloys contain chromium, nickel, silicon and carbon as the required alloying elements, as shown in Table 1. The patented alloys do not have an optimum combination of properties for use as components in critical nuclear installations.

OBJECTS OF THE INVENTION

It is a major object of this invention to provide an alloy steel eminently suited for use as critical components in nuclear installations.

It is another object of this invention to provide an alloy steel with an optimum combination of required properties and at a low cost.

Other objects may be discerned by the discussions and data that follow herein.

SUMMARY OF THE INVENTION

Table 1 presents the composition ranges of the alloy of this invention together with the composition ranges disclosed in U.S. Pat. No. 1,790,177 and certain experimental prior art alloys. The balance of the alloy composition includes iron plus normal impurities found in alloys of this class. Most of the impurities may be adventitious residuals from the alloying elements or processing steps. Some of the impurities may be beneficial, some innocuous, and some harmful as known in the art of this class of iron base alloys.

The chromium, nickel, silicon and carbon are present in the alloy to provide the properties as defined in U.S. Pat. No. 1,790,177.

The chromium must not exceed 25%. More than 25% chromium tends to reduce the ductility of the alloy thereby limiting the hot and cold working properties. At least 15% chromium must be present in the the alloy to provide an adequate degree of corrosion resistance.

Nickel protects the alloy from body centered cubic transformation. Too little, it is believed, gives no protection. Too much, it is believed, modifies the deformation and fracture characteristics of the matrix through its influence on SPE (Stacking fault energy). The range 5 to 15% will provide an adequate balance however, about 7 to 13% is preferred for best results.

Silicon must be present within the range 2.7 to 5.5%. Lower contents will not provide sufficient fluidity in casting and welding operations. Contents over 5.5% tend to promote the formation of excessive intermetallics in the matrix.

Carbon must be present over 1% to provide strength while contents over 3% may result in unacceptable brittleness.

Composition variations (ie. carbon, silicon) may be adjusted within the skill of the art to obtain an alloy that may be hot and/or cold worked into useful wrought products.

Niobium plus vanadium must be present over 5% to prevent the chromium from combining with the carbon thus weakening the matrix. Over 15% will result in a solid solution of modified properties. Six to 12% is preferred for optimum benefits.

Cobalt is not required in the alloy of this invention when used as an article in nuclear operations. The nuclear properties of cobalt (radiation and long half-life) suggest that cobalt contents should be limited to not over 1.5%, and preferrable 1.0%, as an adventitious element commonly found in alloys of this class.

Nitrogen must be controlled in the alloy of this invention not to exceed 0.15%. Over 0.15% may yield an excessive content of nitrides and/or a reduced ductility.

EXPERIMENTAL TESTS

The experimental alloys listed in Table 1 were produced by the aspiration casting process essentially as disclosed in U.S. Pat. No. 4,458,741. There were no particular problems associated with the alloying and casting operations. For the most part, test specimens were easily prepared by the use of gas tungsten arc welding process as two-layer deposits on 1020 grade steel substrate and also as undiluted deposits on chilled copper blocks.

The alloys were given hardness tests on the standard Rockwell Hardness Testing Machines. The results of these tests in Table 2, show that, in general, the hardness values are essentially the same for all the alloys, except Alloy 52. This is somewhat unexpected in view of the large compositional differences of the alloys. The exceptional hardness of Alloy 52 may be attributed to the content of both niobium and vanadium which may have provided complex carbide formations. Thus, the content of both niobium and vanadium is preferred when high hardness is required.

Charpy impact tests were made on unnotched specimens of Alloys 144 and 51. Results are shown in Table 3. Alloy 51, of this invention, has a higher impact strength than Alloy 144, the preferred alloy of U.S. Pat. No. 1,790,177. It is of interest that standard known alloys of this class have impact strength values similar to Alloy 144.

A series of abrasion tests was completed with the experimental alloys. The well known "dry sand rubber wheel test" as described by the American Society for Testing Materials, ASTM test G65, was used. The test result values, given in Table 4, relate to 2,000 revolutions of the rubber wheel and at a test load of 30 lbs. (13.6 Kg). Alloys 51 and 52 of this invention have the lowest volume loss. Alloy 52 appears to resist abrasion more effectively probably because of the combined content of niobium and vanadium.

TABLE 1

| PRIOR ART | Composition Ranges in weight percent, iron balance | | | | | | | |
|---|---|---|---|---|---|---|---|---|
| | Cr | Ni | Si | C | Nb | Nb + V | N | Co |
| U.S. Pat. No. 1,790,177 | 25 to 35 | 5 to 15 | 3.5 to 8 | 1 to 4 | nil | nil | — | — |
| Alloy 128 | 29.28 | 10.65 | 4.89 | 0.96 | nil | nil | .04 | 1.43 |
| Alloy 144 | 28.45 | 9.43 | 4.85 | 2.05 | nil | nil | .03 | .44 |
| Alloy 84 | 25.06 | 10.10 | 6.34 | .88 | nil | nil | .06 | .24 |
| Alloys Of This Invention | | | | | | | | |
| Broad Range | 15 to less than 25 | 5 to 15 | 2.7 to 5.5 | 1 to 3 | — | 5-15 | .15 max | up to 1.5 |
| Intermediate | 17 to 22 | 7 to 13 | 3 to 5.5 | 1.5 to 2.5 | — | 6-12 | .1 max | up to 1.5 |
| Preferred | about 20 | about 10 | about 5.0 | about 1.5 | — | about 8 | about .05 | up to 1 |
| Alloy 51 | 19.99 | 9.54 | 5.13 | 1.67 | 7.38 | about 7.5 | .06 | .88 |
| Alloy 52 | 19.64 | 9.64 | 5.29 | 1.78 | 3.77 | 8.84 | .06 | 1.06 |

TABLE 2

| Room Temperature Hardness of Experimental Alloys | |
|---|---|
| Alloy | Hardness, Rockwell "C" |
| 128 | 44.0 |
| 144 | 43.5 |
| 51 | 40.5 |
| 52 | 53.1 |
| 84 | 43.0 |

TABLE 3

| Charpy Unnotched Impact Strength of Experimental Alloys | | |
|---|---|---|
| Alloy | Impact Strength - Joules (ft. lbf.) | |
| 144 | 4.0 | 3.0 |
| 51 | 5.5 | 4.1 |

TABLE 4

| Resistance to Abrasion of Experimental Alloys | |
|---|---|
| Alloy | Volume Loss - $mm^3$ ($in^3$) |
| 128 | 81.9 ($5.0 \times 10^{-3}$) |
| 144 | 85.8 ($5.2 \times 10^{-3}$) |
| 84 | 89.6 ($5.5 \times 10^{-3}$) |
| 51 | 62.0 ($3.8 \times 10^{-3}$) |

TABLE 4-continued

| Resistance to Abrasion of Experimental Alloys | |
|---|---|
| Alloy | Volume Loss - $mm^3$ ($in^3$) |
| 52 | 40.8 ($2.5 \times 10^{-3}$) |

What is claimed is:

1. A stainless steel suited for use as a component in nuclear installations consisting essentially of, in weight percent, 15 to less than 25 chromium, 5 to 15 nickel, 2.7 to 5.5 silicon, 1 to 3 carbon, niobium plus vanadium 5 to 15, up to 0.15 nitrogen, up to 1.5 cobalt and the balance iron plus impurities wherein niobium is at least 3.77.

2. The alloy of claim 1 wherein chromium is 17 to 22, nickel is 7 to 13, silicon is 3 to 5.5, carbon is 1.5 to 2.5, niobium plus vanadium is 6 to 12, nitrogen is up to 0.1.

3. The alloy of claim 1 wherein chromium is about 20, nickel is about 10, silicon is about 5.0, carbon is about 1.5, niobium plus vanadium is about 8, nitrogen is about 0.05.

4. The alloy of claim 1 wherein chromium is about 20, nickel is about 10.5, silicon is about 5, carbon is about 1.7, niobium is about 7.5, nitrogen is about 0.06 and cobalt is less than 1.0.

5. The alloy of claim 4 wherein niobium is about 3.75 and vanadium is about 5.

6. The alloy of claim 1 in the form of a casting.

7. The alloy of claim 1 wherein the niobium content exceeds the vanadium content.

* * * * *